US010605124B2

(12) United States Patent
Cha

(10) Patent No.: US 10,605,124 B2
(45) Date of Patent: Mar. 31, 2020

(54) HYBRID POWER GENERATING SYSTEM

(71) Applicant: DOOSAN HEAVY INDUSTRIES & CONSTRUCTION CO., LTD., Changwon-si, Gyeongsangnam-do (KR)

(72) Inventor: Song Hun Cha, Osan-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 28 days.

(21) Appl. No.: 16/012,737

(22) Filed: Jun. 19, 2018

(65) Prior Publication Data

US 2019/0024540 A1 Jan. 24, 2019

(30) Foreign Application Priority Data

Jul. 20, 2017 (KR) ..... 10-2017-0092161

(51) Int. Cl.
*F01K 25/10* (2006.01)
*F01K 7/32* (2006.01)
*F01K 13/02* (2006.01)

(52) U.S. Cl.
CPC ..... *F01K 25/103* (2013.01); *F01K 7/32* (2013.01); *F01K 13/02* (2013.01)

(58) Field of Classification Search
CPC ..... F01K 25/103; F01K 25/08; F01K 25/10; F01K 7/32; F01K 13/02; F01K 13/00; F01K 13/006; F01K 17/00; F01K 17/02; F01K 9/00; F01K 9/003
See application file for complete search history.

(56) References Cited

U.S. PATENT DOCUMENTS 4,995,234 A * 2/1991 Kooy ..... F01K 25/10 60/648
2011/0138809 A1* 6/2011 Ramaswamy ..... F01K 25/10 60/641.2
2012/0047892 A1* 3/2012 Held ..... F01K 3/185 60/652
2013/0113221 A1* 5/2013 Held ..... F01K 25/10 290/1 R

FOREIGN PATENT DOCUMENTS

JP 2006-329059 A 12/2006
KR 10-0761976 B1 10/2007

OTHER PUBLICATIONS

A Korean Office Action dated Nov. 12, 2018 in connection with Korean Patent Application No. 10-2017-0092161 which corresponds to the above-referenced U.S. application.

* cited by examiner

*Primary Examiner* — Mark A Laurenzi
*Assistant Examiner* — Xiaoting Hu
(74) *Attorney, Agent, or Firm* — Invenstone Patent, LLC

(57) ABSTRACT

The present disclosure relates to a hybrid power generating system comprising a power generating system using supercritical $CO_2$ configured to use the supercritical $CO_2$ as a working fluid and a liquefied natural gas (LNG) treatment system configured to vaporize LNG, where the working fluid is cooled in at least one of the power generating system using supercritical $CO_2$ and the LNG treatment system and is re-circulated to the power generating system using supercritical $CO_2$.

19 Claims, 8 Drawing Sheets

[FIG. 1]
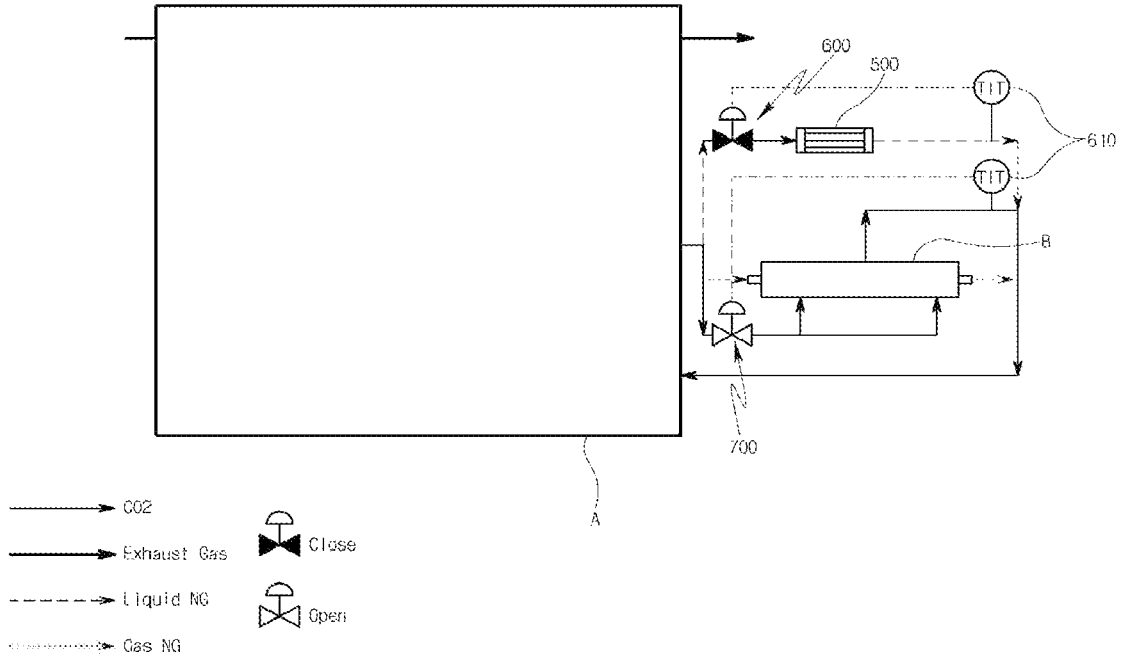

[FIG. 2]
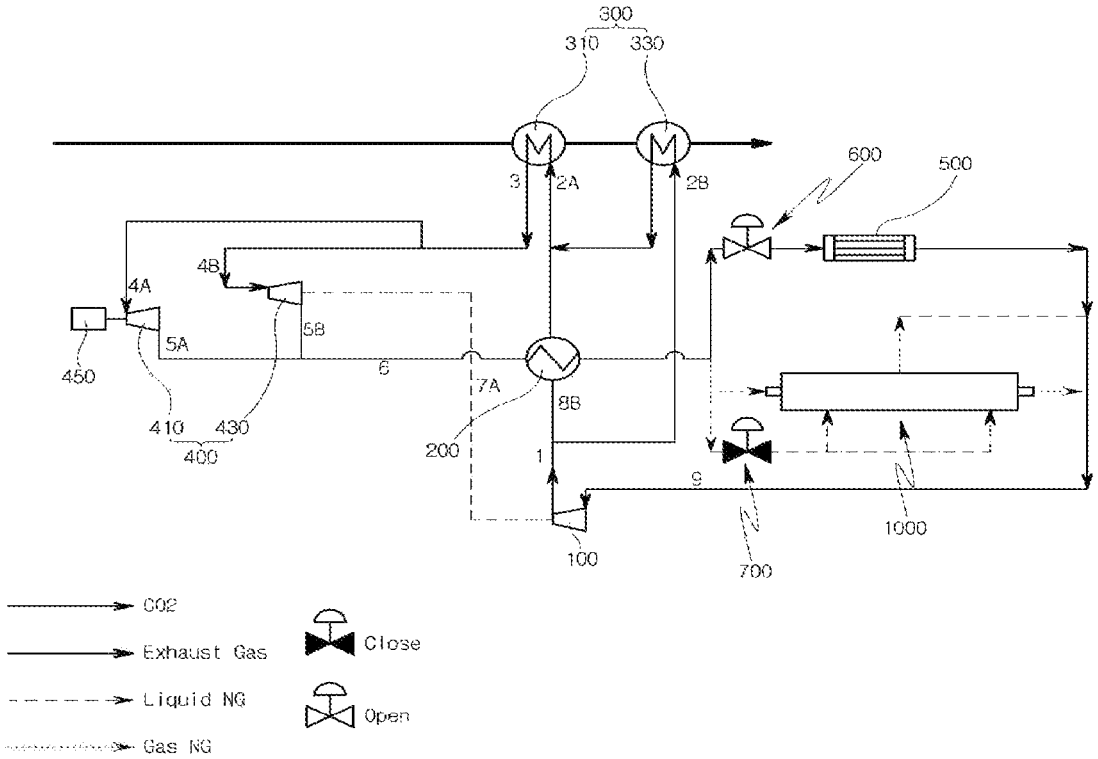

[FIG. 3]
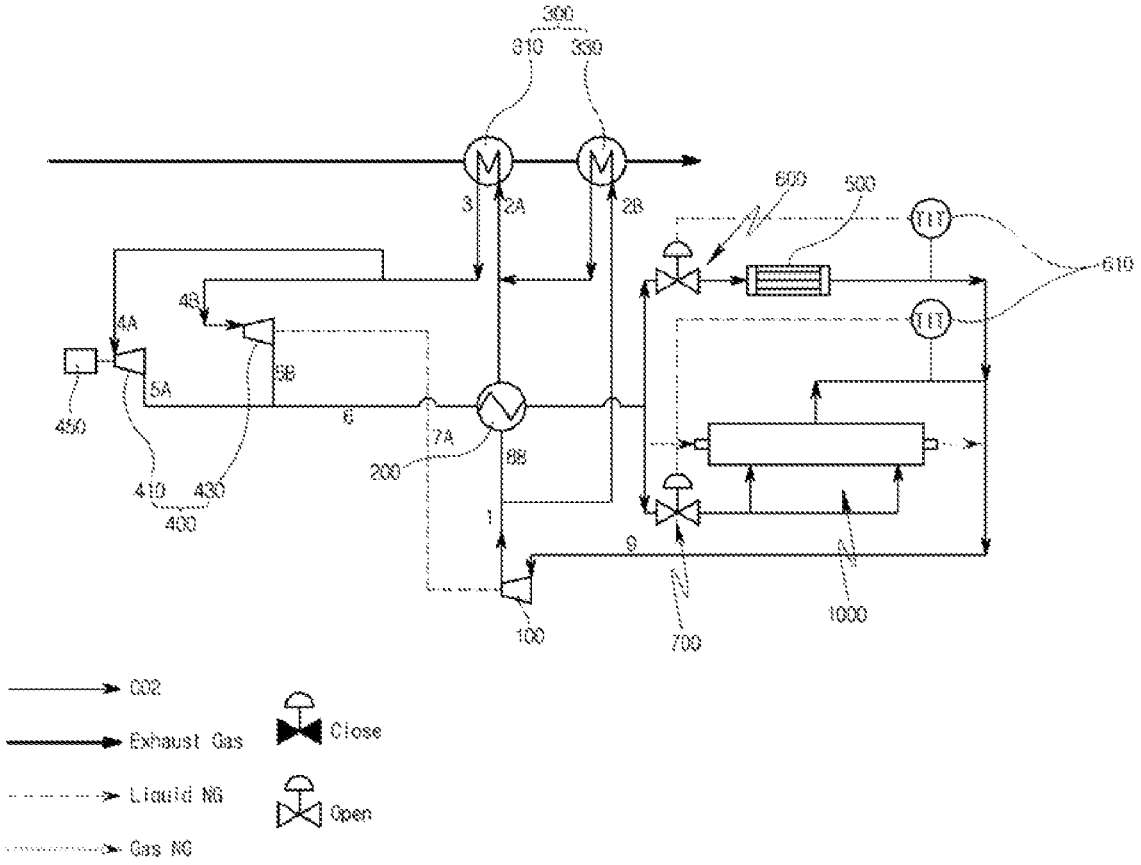

[FIG. 4]
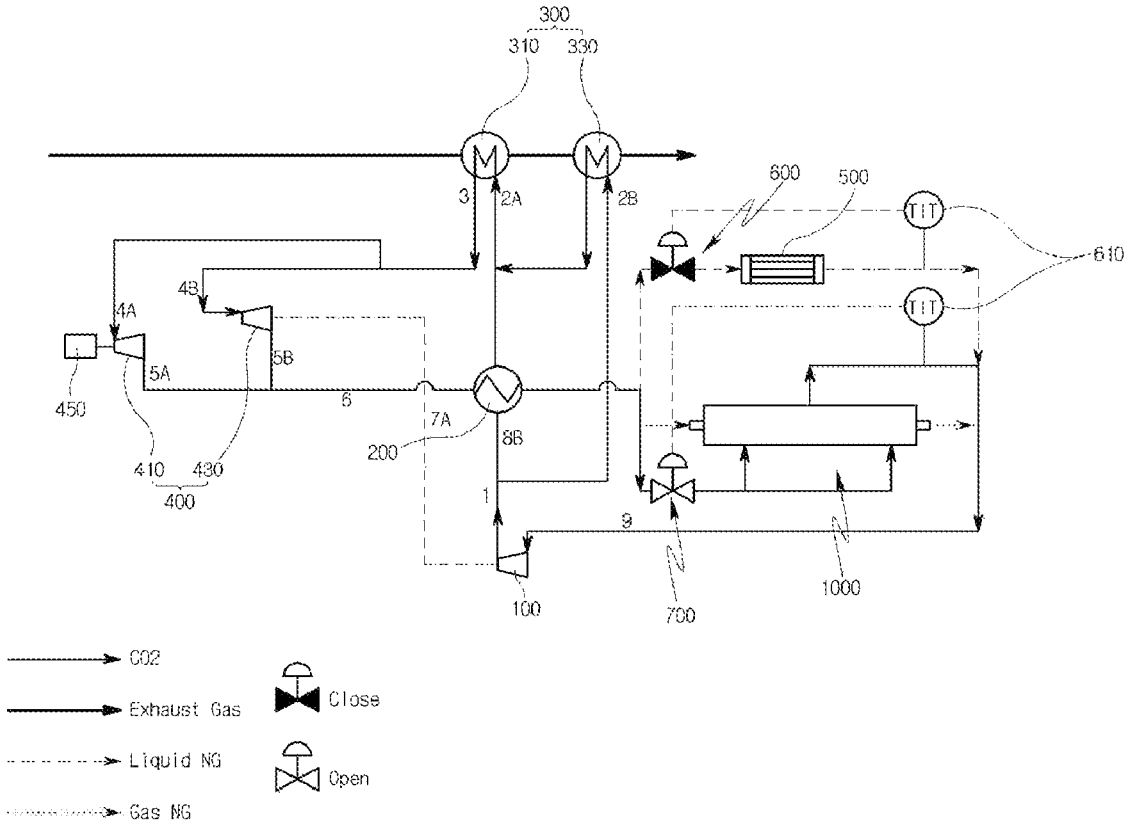

[FIG. 5]
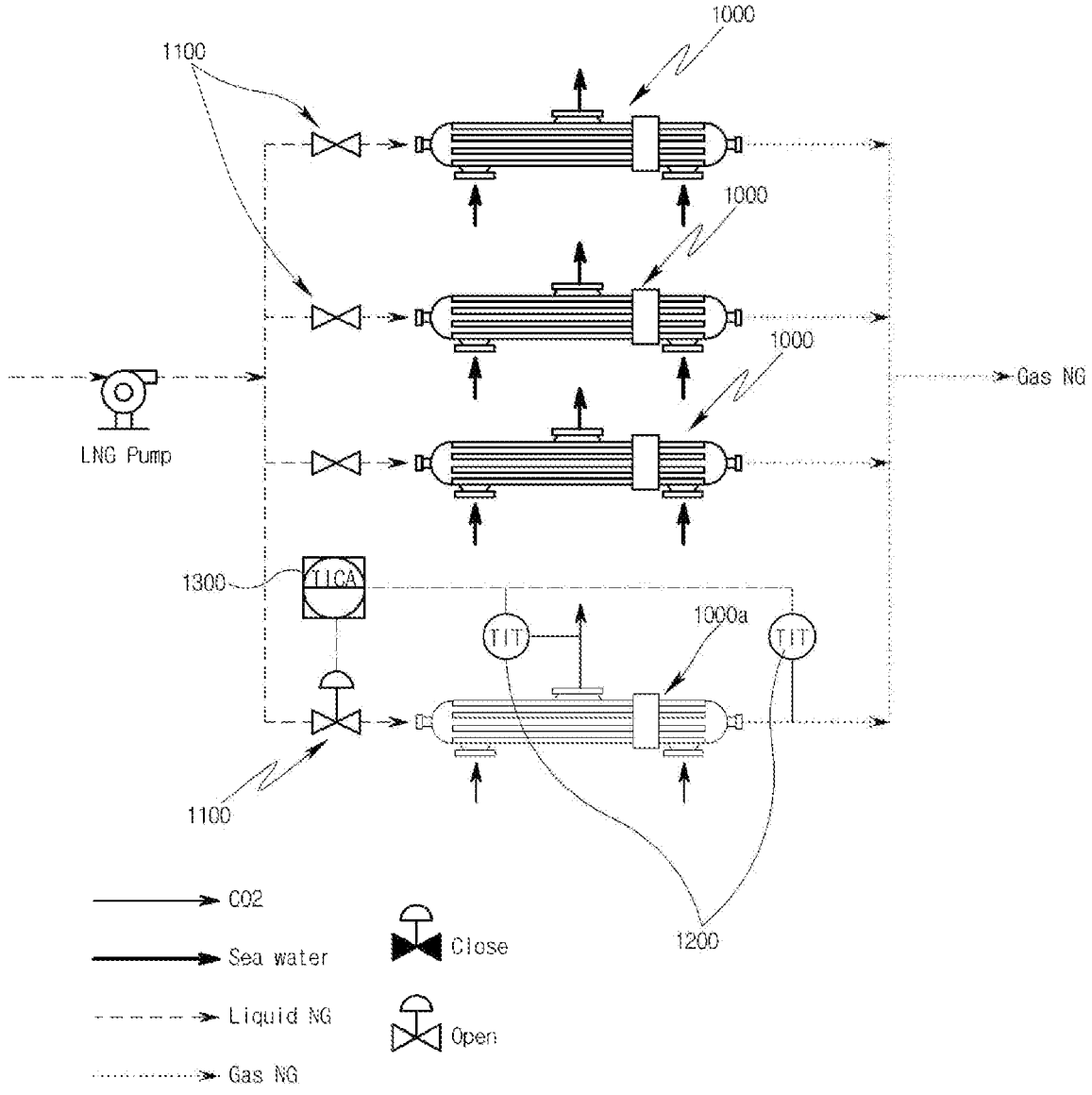

[FIG. 6]
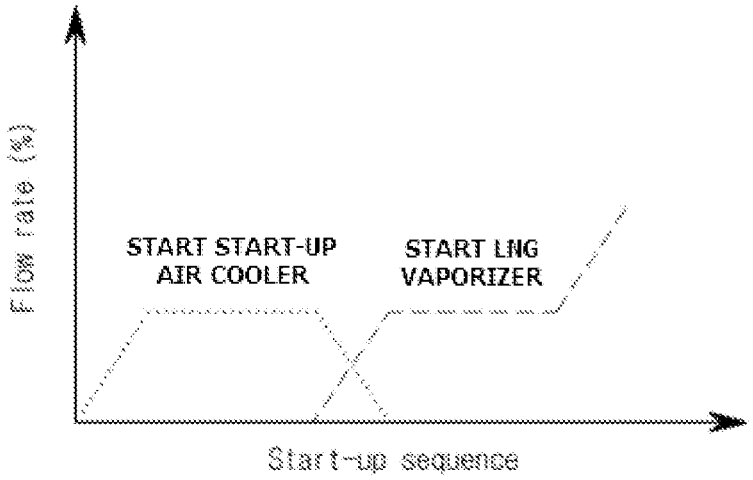

[FIG. 7]
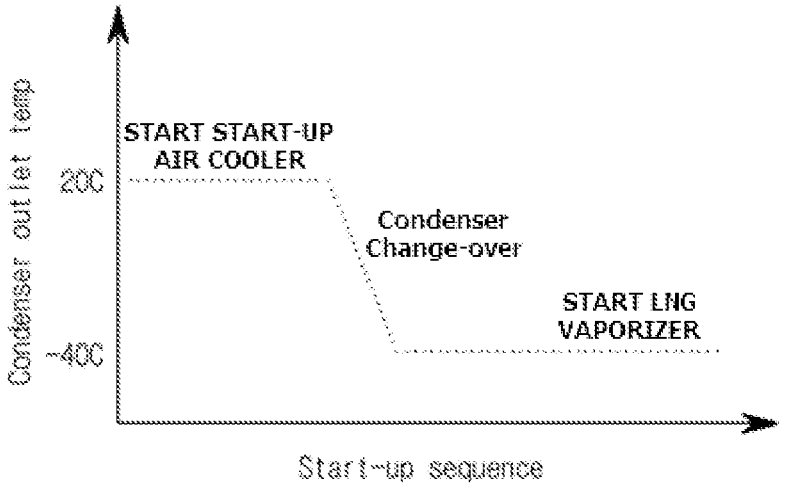

[FIG. 8]
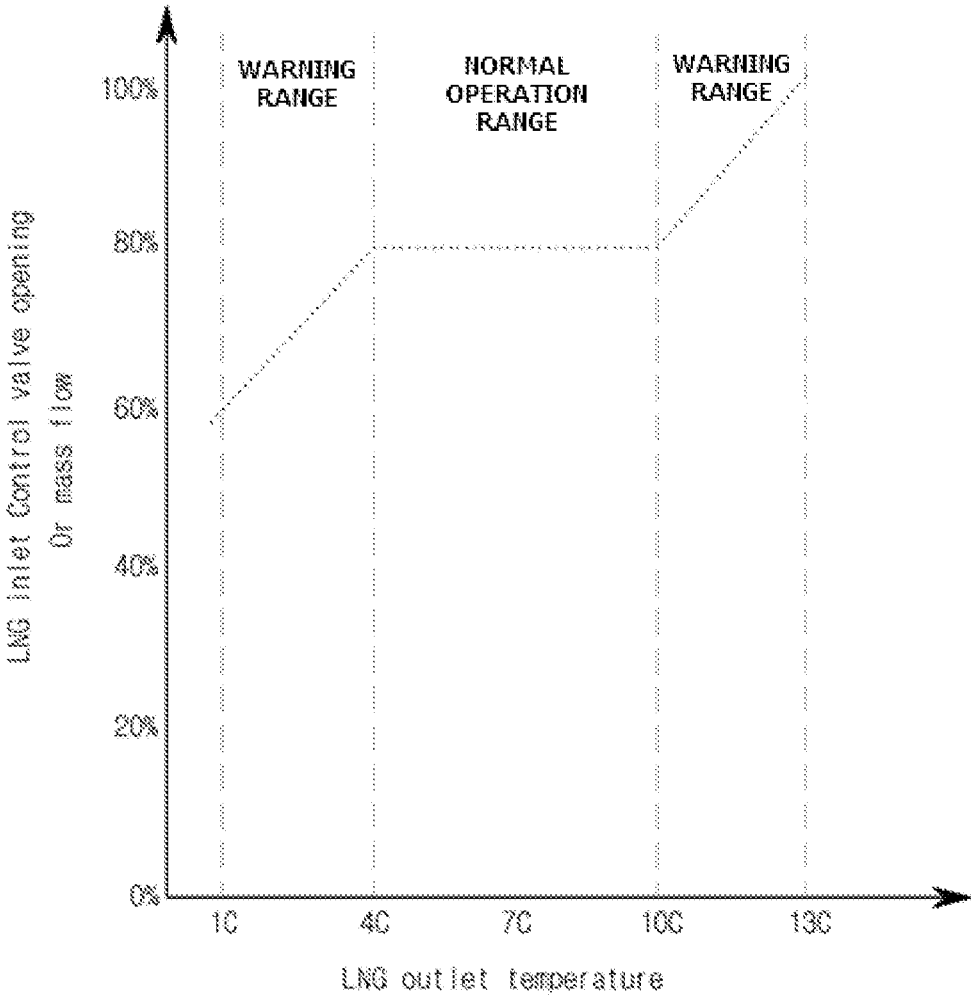

HYBRID POWER GENERATING SYSTEM

CROSS-REFERENCE TO RELATED APPLICATION

This application claims priority to Korean Patent Application No(s). 10-2017-0092161, filed on Jul. 20, 2017, the disclosure of which is incorporated herein by reference in its entirety.

BACKGROUND OF THE DISCLOSURE

Field of the Disclosure

Exemplary embodiments of the present disclosure relate to a hybrid power generating system, and more particularly, to a hybrid power generating system in which supercritical $CO_2$ can be used as a working fluid of a power generating system to vaporize liquefied natural gas (LNG) in an LNG treatment system to improve efficiency of the power generating system and the LNG treatment system.

Description of the Related Art

As a necessity to efficiently produce power is gradually increased, and a move to decrease emission of pollutants has become active globally, various efforts for increasing power production while decreasing emission of pollutants have been made. As one of such efforts, a research and development of a power generating system using supercritical $CO_2$ as a working fluid has been actively conducted.

The supercritical $CO_2$ has a similar density to its liquid state and a similar viscosity to its gas state, thus it is possible to implement miniaturization of a device and significantly decrease power consumption required for compression and circulation of a fluid. At the same time, the supercritical $CO_2$ has a critical point at 31.4° C. and 72.8 atm, which is much lower than that of water having a critical point at 373.95° C. and 217.7 atm, and thus it may be easily handled.

One example of the power generating system using supercritical $CO_2$ is disclosed in U.S. Patent Laid-Open Publication No. 2014-0102098.

SUMMARY OF THE DISCLOSURE

However, the existing power generating system using supercritical $CO_2$ may be difficult to increase capacity beyond a certain scale, and thus a part of the required power amount has to be supplied.

On the other hand, a large amount of seawater is generally used in order to vaporize the LNG in the LNG treatment system. The LNG is at a temperature of −150° C. in its liquid phase, and a large amount of water needs to be supplied to prevent heat-supplying water from being frozen, thereby vaporizing the LNG as gas at 8° C. Therefore, a large amount of seawater at about 14° C. is supplied to heat the LNG, thereby vaporizing the LNG.

A seawater pump is essential to supply a large amount of seawater, and a separate power source is needed to drive the seawater pump. This reduces the overall efficiency of the LNG treatment system.

Therefore, there is a need for improving efficiency of the LNG treatment system and the power generating system using supercritical $CO_2$.

An object of the present disclosure is to provide a hybrid power generating system in which a working fluid of a power generating system using supercritical $CO_2$ can be used to vaporize LNG in an LNG treatment system to improve efficiency of the power generating system using supercritical $CO_2$ and the LNG treatment system.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with one aspect of the present disclosure, a hybrid power generating system comprises a power generating system using supercritical $CO_2$ configured to use the supercritical $CO_2$ as a working fluid, and a liquefied natural gas (LNG) treatment system configured to vaporize LNG, wherein the working fluid is cooled in at least one of the power generating system using supercritical $CO_2$ and the LNG treatment system and is re-circulated to the power generating system using supercritical $CO_2$.

The power generating system using supercritical $CO_2$ may comprise a compressor configured to compress the working fluid, at least one heat exchanger configured to be supplied with heat from an outside heat source to heat a part of the working fluid passing through the compressor, at least one turbine configured to be driven by the working fluid, at least one recuperator configured to be supplied with a part of the working fluid passing through the compressor, exchange heat between the working fluid passing through the turbine and the working fluid passing through the compressor to cool the working fluid passing through the turbine, and heat the working fluid passing through the compressor, and a start-up cooler configured to cool the working fluid cooled in the recuperator through the turbine and supply the cooled working fluid to the compressor, wherein the LNG treatment system comprises a plurality of high-pressure evaporators which vaporizes the LNG.

The hybrid power generating system may further comprise a first control valve configured to branch the working fluid passing through the recuperator and be installed at an inlet end of the start-up cooler and a second control valve configured to be installed at an inlet end of the LNG treatment system.

At the time of an initial driving of the power generating system using supercritical $CO_2$, the first control valve may be open, and the second control valve may be closed, so that the working fluid is re-circulated to the compressor through the start-up cooler.

After the operation of the power generating system using supercritical $CO_2$ is completed, the first control valve and the second control valve may be open to branch the working fluid into the start-up cooler and the high-pressure evaporator.

After the operation of the power generating system using supercritical $CO_2$ is completed, the working fluid may be branched into the high-pressure evaporator to exchange heat in the high-pressure evaporator to be cooled and may then be re-circulated to the compressor.

After the operation of the power generating system using supercritical $CO_2$ is completed, the working fluid may be branched into the start-up cooler to exchange heat in the high-pressure evaporator to be cooled and may then be re-circulated to the compressor.

After the LNG treatment system is operated, the first control valve may be maintained in the closed state and the second control valve may be maintained in the open state.

A closing time of the first control valve may be a time when a flow rate of the working fluid cooled in the high-pressure evaporator becomes a flow rate corresponding to the flow rate of the working fluid cooled in the start-up cooler at the time of the initial driving of the power generating system using supercritical $CO_2$.

The hybrid power generating system may further comprise a temperature controller configured to be installed at an outlet end of the start-up cooler and an outlet end of the high-pressure evaporator, respectively, wherein the flow rate of the working fluid branched into the first control valve and the second control valve, respectively is changed depending on the temperature of the temperature controller.

In accordance with another aspect of the present disclosure, a hybrid power generating system comprises a power generating system using supercritical $CO_2$ configured to use the supercritical $CO_2$ as a working fluid, and a liquefied natural gas (LNG) treatment system configured to vaporize LNG, wherein the working fluid is supplied to any one of the power generating system using supercritical $CO_2$ and the LNG treatment system according to a control mode to be cooled and is then re-circulated to the power generating system using supercritical $CO_2$.

The power generating system using supercritical $CO_2$ may comprise a compressor configured to compress the working fluid, at least one heat exchanger configured to be supplied with heat from an outside heat source to heat a part of the working fluid passing through the compressor, at least one turbine configured to be driven by the working fluid; at least one recuperator configured to be supplied with a part of the working fluid passing through the compressor, exchange heat between the working fluid passing through the turbine and the working fluid passing through the compressor to cool the working fluid passing through the turbine, and heat the working fluid passing through the compressor, and a start-up cooler configured to cool the working fluid cooled in the recuperator through the turbine and supply the cooled working fluid to the compressor, wherein the LNG treatment system comprises a plurality of high-pressure evaporators which vaporizes the LNG, and the hybrid power generating system further comprises a first control valve configured to branch the working fluid passing through the recuperator and be installed at an inlet end of the start-up cooler and a second control valve configured to be installed at an inlet end of the LNG treatment system.

The control mode may comprise an initial driving mode of the power generating system using supercritical $CO_2$ and a switchover mode in which a part or all of the working fluid is supplied with the LNG treatment system to be cooled.

In an initial driving mode of the power generating system using supercritical $CO_2$, the first control valve may be open, and the second control valve may be closed, so that the working fluid is re-circulated to the compressor through the start-up cooler.

When the switchover mode starts, the first control valve and the second control valve may be open to branch the working fluid into the start-up cooler and the high-pressure evaporator.

When the switchover mode starts, the working fluid may be branched into the high-pressure evaporator to exchange heat in the high-pressure evaporator to be cooled and may then be re-circulated to the compressor.

When the switchover mode starts, the working fluid may be branched into the start-up cooler to exchange heat in the high-pressure evaporator to be cooled and may then be re-circulated to the compressor.

After the switchover mode is completed, the first control valve may be maintained in the closed state and the second control valve may be maintained in the open state.

A closing time of the first control valve may be a time when a flow rate of the working fluid cooled in the high-pressure evaporator becomes a flow rate corresponding to the flow rate of the working fluid cooled in the start-up cooler at the time of the initial driving of the power generating system using supercritical $CO_2$.

The hybrid power generating system may further comprise a temperature controller configured to be installed at an outlet end of the start-up cooler and an outlet end of the high-pressure evaporator, respectively, wherein the flow rate of the working fluid branched into the first control valve and the second control valve, respectively is changed depending on the temperature of the temperature controller.

The hybrid power generating system according to the embodiment of the present disclosure has an effect of improving the waste heat recovery efficiency of the power generating system using supercritical $CO_2$ by utilizing the working fluid of the power generating system using supercritical $CO_2$ instead of the seawater required in the LNG treatment system.

In addition, it is possible to improve the whole efficiency of the LNG treatment system by reducing the power consumption of the seawater pump in the LNG treatment system.

BRIEF DESCRIPTION OF THE DRAWINGS

The above and other objects, features and other advantages of the present disclosure will be more clearly understood from the following detailed description taken in conjunction with the accompanying drawings, in which:

FIG. 1 is a schematic diagram illustrating a hybrid power generating system according to an exemplary embodiment of the present disclosure;

FIG. 2 is a schematic diagram showing an initial driving state of a power generating system using supercritical $CO_2$ according to the hybrid power generating system of FIG. 1;

FIG. 3 is a schematic diagram showing a switchover mode start state after driving of the power generating system using supercritical $CO_2$ according to the hybrid power generating system of FIG. 1 is completed;

FIG. 4 is a schematic diagram showing a switchover completion mode state according to the hybrid power generating system of FIG. 1;

FIG. 5 is a schematic diagram showing an example of a high-pressure evaporating apparatus in an LNG treatment system according to the hybrid power generating system of FIG. 2;

FIG. 6 is a graph showing the initial driving of the power generating system using supercritical $CO_2$ according to the hybrid power generating system of FIG. 2;

FIG. 7 is a graph showing an outlet temperature of a start-up cooler during the initial driving of the power generating system using supercritical $CO_2$ according to the hybrid power generating system of FIG. 2; and FIG. 8 is a graph showing outlet temperature and inlet temperature openings according to a high-pressure evaporating apparatus in an LNG treatment system of FIG. 7.

DESCRIPTION OF SPECIFIC EMBODIMENTS

Hereinafter, a hybrid power generating system according to an exemplary embodiment of the present disclosure will be described in detail with reference to the accompanying drawings.

FIG. 1 is a schematic diagram illustrating a hybrid power generating system according to an exemplary embodiment of the present disclosure.

As shown in FIG. 1, generally, a power generating system A using supercritical $CO_2$ configures a close cycle in which $CO_2$ used for power generation is not emitted to outside, and it uses the supercritical $CO_2$ as a working fluid.

The power generating system A using supercritical $CO_2$ can use exhaust gas emitted from a thermal power plant or the like since the working fluid is the supercritical $CO_2$. Accordingly, the power generating system using supercritical $CO_2$ may be used not only as a single power generation system but also as a hybrid power generation system with a thermal power generation system. The working fluid of the power generating system using supercritical $CO_2$ may be supplied by separating $CO_2$ from the exhaust gas or by supplying separate $CO_2$.

The supercritical $CO_2$ in the cycle (hereinafter, referred to as working fluid) passes through a compressor, and is then heated while passing through a heat source such as a heater, etc. to become a high-temperature and high-pressure working fluid used to operate a turbine. A generator or a compressor is connected to the turbine, power is generated by the turbine connected to the generator, and the compressor is operated by using the turbine connected to the compressor. The working fluid passing through the turbine is cooled while passing through the heat exchanger, and the cooled working fluid is supplied to the compressor again to circulate in the cycle. It is appreciated that the turbine or the heat exchanger may be provided in plural.

The power generating system using supercritical $CO_2$ according to various exemplary embodiments of the present disclosure comprise a system in which all working fluids flowing in the cycle are supercritical and a system in which most working fluids are supercritical and the rest of the working fluids are subcritical.

Further, in various exemplary embodiments of the present disclosure, $CO_2$ is used as a working fluid, and here, $CO_2$ comprises carbon dioxide which is chemically pure, carbon dioxide which includes some impurities in general terms, and a fluid in which carbon dioxide is mixed with one or more fluids as additives.

It is to be noted, in the present disclosure, that terms "low temperature" and "high temperature" have relative meanings, thus should not be understood as being a temperature higher or lower than a specific reference temperature. Terms "low pressure" and "high-pressure" also should be understood as having relative meanings.

Each of the components of the present disclosure is connected to each other by a transfer tube (meaning each line attached with a number) in which the working fluid flows, and unless specially mentioned, it is to be understood that the working fluid flows along the transfer tube. However, when a plurality of components are integrated, the integrated configuration may be a part or an area serving as the transfer tube in actuality. Therefore, even in this case, it is to be understood that the working fluid flows along the transfer tube. A flow path having a separate function will be additionally described. The flow of the working fluid will be described by assigning reference numerals to the transfer tube.

An LNG treatment system B means a facility that transfers liquefied natural gas through a vessel and then supplies the transferred liquefied natural gas to a land treatment facility.

The vessel is equipped with an LNG storage tank and a supply pump, and supplies LNG, which is in a super low temperature state of −160° C. or so, to a treatment system. The LNG passes through a condenser and a high-pressure pump before being transferred to the treatment system, and it is transferred to a high-pressure evaporating apparatus in the treatment system. The high-pressure evaporating apparatus gasifies the LNG by exchanging heat between the LNG and seawater supplied by a seawater pump and transfers the gasified LNG to sources. The seawater cooled by being deprived of heat is discharged to outside of the treatment system.

In the present disclosure, high-pressure evaporating apparatuses are provided in plural (see FIG. 5). The present disclosure includes a method for allowing some of the high-pressure evaporating apparatuses to exchange heat with seawater to gasify LNG and for allowing the rest of the high-pressure evaporating apparatuses to exchange heat with a working fluid of the power generating system using supercritical $CO_2$ to gasify the LNG.

For convenience, the LNG treatment system in the present disclosure will be described by indicating only the high-pressure evaporation apparatuses in the LNG treatment system.

Further, the power generating system using supercritical $CO_2$ described in the present disclosure is merely an example, and it is not limited to the number and arrangement of each component disclosed.

FIG. 2 is a schematic diagram showing an initial driving state of a power generating system using supercritical $CO_2$ according to the hybrid power generating system of FIG. 1, FIG. 3 is a schematic diagram showing a switchover mode start state after driving of the power generating system using supercritical $CO_2$ according to the hybrid power generating system of FIG. 1 is completed, and FIG. 4 is a schematic diagram showing a switchover completion mode state according to the hybrid power generating system of FIG. 1. FIG. 5 is a schematic diagram showing an example of a high-pressure evaporating apparatus in the LNG treatment system according to the hybrid power generating system of FIG. 2, FIG. 6 is a graph showing the initial driving of the power generating system using supercritical $CO_2$ according to the hybrid power generating system of FIG. 2, FIG. 7 is a graph showing an outlet temperature of a start-up cooler at the time of the initial driving of the power generating system using supercritical $CO_2$ according to the hybrid power generating system of FIG. 2, and FIG. 8 is a graph showing outlet temperature and inlet temperature openings according to a high-pressure evaporating apparatus in an LNG treatment system of FIG. 7.

As shown in FIG. 2, the power generating system A using supercritical $CO_2$ according to an embodiment of the present disclosure may be configured to comprise a pump or compressor 100 which compresses and circulates a working fluid, at least one recuperator 200 which heats the working fluid, at least one heat exchanger 300 which recovers waste heat from waste heat gas as an external heat source to further heat the working fluid, at least one turbine 400 which is driven by the working fluid to produce electric power, and a start-up cooler 500 which serves as a condenser for cooling the working fluid. In the present embodiment, the configuration in which the heat exchanger 300 is configured to comprise a first heat exchanger 310 and a second heat exchanger 330, the compressor 100 and the recuperator 200 are provided one by one, and the turbine 400 is configured to comprise a first turbine 410 and a second turbine 430 will be described as an example.

The compressor 100 is driven by the second turbine 430, as will be described later (see a dotted line in FIG. 2), transfers a part of the low-temperature working fluid cooled by the start-up cooler 500 to the recuperator 200, and transfers the rest of the low-temperature working fluid to the second heat exchanger 330.

The recuperator 200 exchanges heat between the working fluid through the compressor 100 and the working fluid through the turbine 400. The working fluid primarily cooled in the recuperator 200 through the turbine 400 is supplied to the start-up cooler 500 to be re-cooled, and it is then circulated to the compressor 100. The working fluid heated by exchanging heat with the working fluid passing through the turbine 400 in the recuperator 200 is mixed with the working fluid primarily heated by the second heat exchanger 330 and then transferred to the first heat exchanger 310.

The first heat exchanger 310 and the second heat exchanger 330 use, as a heat source, gas (hereinafter, waste heat gas) having waste heat like exhaust gas emitted from a boiler of a power plant, and they serve to exchange heat between the waste heat gas and a working fluid circulating within a cycle to heat the working fluid with the heat supplied from the waste heat gas.

In addition, the first heat exchanger 310 and the second heat exchanger 330 may be classified into a relatively low temperature, medium temperature, high temperature or the like depending on the temperature of the waste heat gas. That is, the heat exchanger 300 can perform heat exchange at the high temperature as it approaches an inlet end into which the waste heat gas is introduced, and it performs heat exchange at the lower temperature as it approaches an outlet end through which the waste heat gas is discharged.

In the present embodiment, the first heat exchanger 310 may be a heat exchanger using relatively high or medium-temperature waste heat gas compared to the second heat exchanger 330, and the second heat exchanger 330 may be a heat exchanger using the relatively medium or low-temperature waste heat gas. That is, an example in which the first heat exchanger 310 and the second heat exchanger 330 are sequentially disposed from the inlet end into which the waste heat gas is introduced toward the outlet end will be described.

The turbine 400 is configured to comprise the first turbine 410 and the second turbine 430, and it is driven by the working fluid to drive a generator 450 connected to at least any one turbine of the turbines, thereby generating power. The working fluid is expanded while passing through the first turbine 410 and the second turbine 430, where the turbines 410 and 430 also serve as an expander. According to the present embodiment, the generator 450 is connected to the first turbine 410 to generate power, and the second turbine 430 serves to drive the compressor 100. Therefore, the first turbine 410 may have a relatively higher pressure than the second turbine 430.

The start-up cooler 500 serves as a condenser for cooling the working fluid passing through the recuperator 200 using air or cooling water as a refrigerant. A part or all of the working fluid that passes through the recuperator 200 is supplied to the start-up cooler 500 to be cooled, and it is then circulated to the compressor 100. The working fluid of the power generating system using supercritical $CO_2$ may be partly branched to the LNG treatment system B depending on the driving mode of the hybrid power generating system, as will be described below.

In the present disclosure, the start-up cooler 500 serves to cool the working fluid without affecting the operation state of the LNG treatment system B during the initial driving of the power generating system A using supercritical $CO_2$.

Therefore, it is preferable that the working fluid is circulated only in the power generating system A using supercritical $CO_2$ during the initial driving of the power generating system A using supercritical $CO_2$. To this end, it is preferable that an inlet end of the start-up cooler 500 and an inlet end of the LNG treatment system B are each provided with a control valve 1100 (See FIG. 5). Therefore, at the time of the initial driving of the power generating system A using supercritical $CO_2$, a first control valve 600 provided at the inlet end of the start-up cooler 500 is open, and a second control valve 700 provided at the inlet end of the LNG treatment system B is closed (see FIG. 2).

The LNG treatment system B comprises a plurality of high-pressure evaporators 1000, in which the cooling water or the working fluid of the power generating system using supercritical $CO_2$ is introduced into each of the high-pressure evaporators 1000 and exchanges heat with the LNG and then exits the high-pressure evaporators 1000.

Some of the high-pressure evaporators 1000 are supplied with seawater at one side in a width direction, where the seawater cooled by being deprived of heat is discharged to outside of the system, and the natural gas (NG) introduced into one side of a longitudinal direction and vaporized by heat being supplied exits the high-pressure evaporator 1000 at the other side in the longitudinal direction.

In addition, some of the high-pressure evaporators **1000*a* are supplied with the working fluid of the power generating system A using supercritical $CO_2$ (e.g., at one side in the width direction), and the working fluid cooled by being deprived of heat is again supplied to the compressor of the power generating system A using supercritical $CO_2$ (e.g., at the other side in the width direction). The LNG is introduced into at one side of the longitudinal direction of the high-pressure evaporator 1000*a*** to be heated and vaporized, and then exits at the other side in the longitudinal direction.

The LNG inlet end of each of the high-pressure evaporators 1000 is provided with a flow control valve 1100, and the LNG outlet end and the working fluid outlet end of the high-pressure evaporator 1000, which uses the working fluid as a vaporizing heat source, are each provided with a temperature sensor 1200. The flow rate control of the LNG interlocks with a flow rate controller 1300 which operates in interlocking with the flow control valve 1100 provided at the LNG inlet end, as will be described later.

The control of the hybrid power generating system of the present disclosure may be divided into the following.

That is, during the initial driving of the power generating system A using supercritical $CO_2$, the state driven separately from the LNG treatment system B may be divided into an initial drive mode, and a switchover mode in which a part of the working fluid of the power generating system A using supercritical $CO_2$ is supplied to the LNG treatment system B. In addition, the switchover mode may be separately controlled at the time of start and completion.

As described above, the control state for circulating the working fluid as in the initial driving of the power generating system A using supercritical $CO_2$ shown in FIG. 2 corresponds to the initial driving mode.

When the switchover mode starts, as shown in FIG. 3, the first control valve 600 and the second control valve 700 are both controlled to be open, and when the switchover mode completes, as shown in FIG. 4, the first control valve 600 is closed and the second control valve 700 is open. This will be described in more detail.

As show in FIG. 3, if the stable start-up of the power generating system A using supercritical $CO_2$ using the start-up cooler 500 is completed, when the switchover mode of the high-pressure evaporators 10 to 50 (see FIGS. 7 and 8) in the LNG treatment system starts, the working fluid is branched from a front end of the start-up cooler 500 and supplied to the start-up cooler 500 and the LNG treatment system B, respectively. To this end, the first control valve 600 and the second control valve 700 are both open.

The working fluid cooled in the start-up cooler 500 is not directly supplied to the power generating system A using supercritical $CO_2$ but is first supplied to the LNG treatment system B. This is because the temperature of the working fluid may be lower when the working fluid passes through the LNG treatment system B than when the single operation of the power generating system A using supercritical $CO_2$ is performed to improve the heat exchange efficiency (which will be described with reference to FIGS. 6 and 7).

The flow rate of the working fluid supplied to the start-up cooler 500 and the LNG treatment system B may be distributed by a temperature measuring instrument 610 which is provided at a rear end of the start-up cooler 500 and a rear end of the high-pressure evaporator 1000 of the LNG treatment system B, respectively.

If the switchover for transferring the working fluid to the LNG treatment system B is completed, as shown in FIG. 4, the driving of the start-up cooler 500 stops and the single operation of high-pressure evaporator 1000 in the LNG treatment system B is performed. Accordingly, the first control valve 600 is closed and the second control valve 700 is open.

FIG. 6 briefly describes the control flow at the time of the initial driving and the switchover as described above. In FIG. 6, the start-up cooler 500 starts to operate at the time of the initial driving of the power generating system A using supercritical $CO_2$ to maintain the flow rate of the working fluid to be a predetermined level or more (horizontal section in FIG. 6) so that the working fluid is supplied to the LNG treatment system B. If the cooling treatment flow rate of the working fluid in the LNG treatment system B is maintained at a certain level or more, the driving of the start-up cooler 500 stops (zero point of the start-up cooler flow rate in FIG. 6), and the working fluid is cooled only by the LNG treatment system B. In the case of the LNG treatment system B, since the high-pressure evaporator 1000 is provided in plural, the amount of LNG to be vaporized increases over the control time, thus the treatment flow rate of the working fluid may increase.

The change in the temperature of the start-up cooler 500 and the high-pressure evaporator 1000 according to the respective points in FIG. 6 are shown in FIG. 7. That is, if the outlet temperature of the start-up cooler is about 20° C. when the start-up cooler 500 starts, when the high-pressure evaporator 1000 starts to be driven while the switchover starts, the temperature of the working fluid starts to gradually fall. Thereafter, if the working fluid starts to be cooled only by the high-pressure evaporator 1000 after the driving of the star-up cooler 500 stops, the temperature of the working fluid at the rear end of the high-pressure evaporator 1000 may drop to −40° C. or less.

In the case of the power generating system using supercritical $CO_2$ which uses the supercritical $CO_2$ as the working fluid, the system can be driven even within the range in which the temperature of the working fluid is −30° C. to 50° C. in characteristics of the supercritical $CO_2$. In the case of the LNG treatment system, it is impossible to lower the temperature of the seawater to 0° C. to prevent cooling water from freezing. However, when the working fluid of the power generating system using supercritical $CO_2$ is applied, the temperature can be lowered to −50° C., thereby reducing the usage of the seawater. Therefore, the power consumption of the seawater supply pump can be reduced.

In addition, even in the case of the power generating system using supercritical $CO_2$, since the low-temperature working fluid is supplied to inside of the system as compared with the use of the start-up cooler 500, the heat exchange efficiency is improved so that the performance can be improved by about 15 to 20% as compared with the existing cycle.

Also, as shown in FIG. 8, the temperature of the LNG outlet end can be monitored by the temperature sensor 1200 to control the flow rate of the LNG. When the flow rate control valve 1100 of the LNG is not controlled within the normal operation range, but the temperature of the LNG outlet end is lower than the normal range, the flow rate control valve 1100 is closed to reduce the flow rate of the LNG introduced into the high-pressure evaporator 1000. Thus, the temperature of the LNG outlet end rises to return to the normal range (see FIG. 6 for the configuration diagram).

On the contrary, if the temperature of the LNG outlet end is higher than the normal operation range, the flow rate control valve 1100 of the LNG is open to increase the flow rate of the LNG. Thus, the temperature of the LNG outlet end drops to return to the normal range.

The exemplary embodiments of the present disclosure described above and illustrated in the drawings should not be interpreted as limiting the technical idea of the present disclosure. The scope of the present disclosure is limited only by the accompanying claims, and those skilled in the art may modify and change the technical idea of the present disclosure in various forms. Therefore, it is obvious to those skilled in the art that these alterations and modifications fall within the scope of the present disclosure.

What is claimed is:

1. A hybrid power generating system comprising:

a power generating system configured to use supercritical $CO_2$ as a working fluid, the power generating system passing the working fluid through at least one recuperator of the power generating system and comprising a startup cooler configured to cool the passed working fluid and to recirculate the cooled working fluid to the power generating system;

a liquefied natural gas (LNG) treatment system comprising a high-pressure evaporator configured to vaporize LNG, to cool the working fluid passing through the at least one recuperator, and to recirculate the cooled working fluid to the power generating system;

a first control valve installed at an inlet end of the startup cooler and configured to pass at least a portion of the working fluid from the at least one recuperator to the startup cooler;

a second control valve installed at an inlet end of the high-pressure evaporator and configured to pass least a portion of the working fluid from the at least one recuperator to the high-pressure evaporator; and a temperature controller installed at an outlet end of the start-up cooler and an outlet end of the high pressure evaporator, respectively, and configured to control the flow rate of the working fluid passing through the first and second control valves, respectively, depending on a first temperature detected at the outlet end of the start-up cooler by the temperature controller and a second temperature detected at the outlet end of the high-pressure evaporator by the temperature controller, wherein the temperature controller is further configured to control the flow rate of the working fluid passing through the first and second control valves, respectively, according to a control mode including one of an initial driving mode of the power generating system using supercritical $CO_2$ in which all of the working fluid is supplied to the startup cooler to be cooled and switchover mode of the hybrid power generating system in which part or all of the working fluid is supplied to the LNG treatment system to be cooled, the initial driving mode starting upon an initial driving of the power generating system and the switchover mode being operated only after completion of the initial driving mode.

2. The hybrid power generating system of claim 1, wherein the power generating system further comprises:

a compressor configured to compress the working fluid that is recirculated to the power generating system from at least one of the startup cooler and the high-pressure evaporator;

at least one heat exchanger configured to be supplied with heat from an outside heat source to heat a part of the working fluid passing through the compressor; and at least one turbine configured to be driven by the working fluid, wherein the at least one recuperator is configured to be supplied with a part of the working fluid passing through the compressor, exchange heat between the working fluid passing through the at least one turbine and the working fluid passing through the compressor, heat the working fluid passing through the compressor, and to pass the working fluid to the first and second control valves.

3. The hybrid power generating system of claim 1, wherein, during the initial driving mode of the power generating system using supercritical $CO_2$, the temperature controller controls the first control valve to be open and the second control valve to be closed so that only the portion of the working fluid passing to the startup cooler is recirculated to the power generating system.

4. The hybrid power generating system of claim 3, wherein, during the initial driving mode, the temperature controller controls the first control valve so that the working fluid from the at least one recuperator exchanges heat in the startup cooler to be cooled and is then recirculated to the power generating system.

5. The hybrid power generating system of claim 1, wherein, after the switchover mode of the hybrid power generating system starts, the temperature controller controls the first and second control valve to both be open in order to pass the working fluid to the start-up cooler and to the high-pressure evaporator.

6. The hybrid power generating system of claim 5, wherein, after the switchover mode is completed, the temperature controller controls the second control valve so that the working fluid from the power generating system exchanges heat in the high-pressure evaporator to be cooled and is then recirculated to the power generating system.

7. The hybrid power generating system of claim 5, wherein the temperature controller closes the first control valve at a closing time corresponding to a time, during the switchover mode, when the flow rate of the working fluid ended in the high-pressure evaporator equals the flow rate of the working fluid cooled in the startup cooler.

8. The hybrid power generating system of claim 1, wherein, after completion of the initial driving mode of the power generation system using supercritical $CO_2$ and the switchover mode of the hybrid power generation system, the temperature controller controls the first control valve to be maintained in a closed state and controls the second control valve to be maintained in an open state.

9. The hybrid power generating system of claim 1, wherein the cooled working fluid from the high-pressure evaporator is recirculated to the power generating system separately from the cooled working fluid from the startup cooler.

10. The hybrid power generating system of claim 1, wherein the outlet end of the high-pressure evaporator communicates with a transfer tube connected to the power generating system, and the outlet end of the startup cooler communicates with the transfer tube.

11. A hybrid power generating system comprising:

a power generating system configured to use supercritical $CO_2$ as a working fluid, the power generating system passing the working fluid through at least one recuperator of the power generating system and comprising a startup cooler configured to cool the passed working fluid and to recirculate the cooled working fluid to the power generating system;

a liquefied natural gas (LNG) treatment system comprising a high-pressure evaporator configured to vaporize LNG, to cool the working fluid passing through the at least one recuperator, and to recirculate the cooled working fluid to the power generating system;

a first control valve installed at an inlet end of the startup cooler and configured to pass at least a portion of the working fluid from the at least one recuperator to the startup cooler;

a second control valve installed at an end of the high-pressure evaporator and configured to pass at least a portion of the working fluid from the at least one recuperator to the high-pressure evaporator; and a temperature controller installed at an outlet end of the starts-up cooler and an outlet end of the high-pressure evaporator, respectively, and configured to control the flow rate of the working fluid passing through the first and second control valves, respectively, according to a control mode including one of an initial driving mode of the power generating system using supercritical $CO_2$ in which all of the working fluid is supplied to the startup cooler to be cooled and a switchover mode of the hybrid power generating system in which part or all of the working fluid is supplied to the LNG treatment system to be cooled, the initial driving mode starting upon an initial driving of the power generating system and the switchover mode being operated only after completion of the initial driving mode.

12. The hybrid power generating system of claim 11, wherein the power generating system further comprises:

a compressor configured to compress the working fluid that is recirculated to the power generating system from at least one of the startup cooler and the high-pressure evaporator;

at least one heat exchanger configured to be supplied with heat from an outside heat source to heat a part of the working fluid passing through the compressor; and at least one turbine configured to be driven by the working fluid, wherein the at least one recuperator configured to be supplied with a part of the working fluid passing through the compressor, exchange heat between the working fluid passing through the at least one turbine and the working fluid passing through the compressor, heat the working fluid passing through the compressor, and to pass the working fluid to the first and second control valves.

13. The hybrid power generating system of claim 11, wherein, during the initial driving mode, the temperature controller controls the first control valve to be open and the second control valve to be closed so that only the portion of the working fluid passing to the startup cooler is recirculated to the power generating system.

14. The hybrid power generating system of claim 13, wherein, during the initial driving mode, the temperature controller controls the first control valve so that the working fluid from the at least one recuperator exchanges heat in the startup cooler to be cooled and is then recirculated to the power generating system.

15. The hybrid power generating system of claim 11, wherein, when the switchover mode starts, the temperature controller controls the first and second control valves to both be open in order to pass the working fluid to the start-up cooler and to the high-pressure evaporator.

16. The hybrid power generating system of claim 15, wherein, after the switchover mode is completed, the temperature controller controls the second control valve so that the working fluid from the power generating system exchanges heat in the high-pressure evaporator to be cooled and is then recirculated to the power generating system.

17. The hybrid power generating system of claim 15, wherein the temperature controller closes the first control valve at a closing time corresponding to a time, during the switchover mode, when the flow rate of the working fluid cooled in the high-pressure evaporator equals the flow rate of the working fluid cooled in the startup cooler.

18. The hybrid power generating system of claim 11, wherein, after the switchover mode is completed, the temperature controller controls the first control valve to be maintained in a closed state and controls the second control valve to be maintained in an open state.

19. The hybrid power generating system of claim 11, wherein the temperature controller is further configured to control the flow rate of the working fluid passing through the first and second control valves, respectively, depending on a first temperature detected at the outlet end of the start-up cooler by the temperature controller and a second temperature detected at the outlet end of the high-pressure evaporator by the temperature controller.

* * * * *